US009488328B2

(12) United States Patent
Sakashita

(10) Patent No.: US 9,488,328 B2
(45) Date of Patent: Nov. 8, 2016

(54) VEHICLE LAMP

(71) Applicant: KOITO MANUFACTURING CO., LTD., Tokyo (JP)

(72) Inventor: Kazuhisa Sakashita, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 0 days.

(21) Appl. No.: 14/507,314

(22) Filed: Oct. 6, 2014

(65) Prior Publication Data

US 2015/0103549 A1 Apr. 16, 2015

(30) Foreign Application Priority Data

Oct. 11, 2013 (JP) ..... 2013-213872

(51) Int. Cl.
*F21S 8/10* (2006.01)
*F21Y 101/02* (2006.01)
*F21Y 105/00* (2016.01)

(52) U.S. Cl.
CPC ..... *F21S 48/1388* (2013.01); *F21S 48/1154* (2013.01); *F21S 48/1266* (2013.01); *F21S 48/1283* (2013.01); *F21S 48/1291* (2013.01); *F21S 48/1323* (2013.01); *F21S 48/32* (2013.01); *F21Y 2101/02* (2013.01); *F21Y 2105/00* (2013.01)

(58) Field of Classification Search
CPC ..... F21S 48/1291; F21S 48/1388
USPC ..... 362/516
See application file for complete search history.

(56) References Cited

U.S. PATENT DOCUMENTS

| | | | | |
|---|---|---|---|---|
| 6,382,822 | B1 * | 5/2002 | Maekawa et al. | 362/522 |
| 2005/0063191 | A1 * | 3/2005 | Larsen | 362/510 |
| 2007/0002577 | A1 | 1/2007 | Tsukamoto | |
| 2007/0047248 | A1 * | 3/2007 | Tsukamoto et al. | 362/520 |
| 2007/0127253 | A1 * | 6/2007 | Kawashima et al. | 362/509 |
| 2012/0140508 | A1 | 6/2012 | Owada | |
| 2012/0188781 | A1 | 7/2012 | Futami | |
| 2013/0322105 | A1 * | 12/2013 | Uchida et al. | 362/517 |

FOREIGN PATENT DOCUMENTS

| | | | |
|---|---|---|---|
| EP | 0997343 | A2 | 5/2000 |
| EP | 2237080 | A1 | 10/2010 |

(Continued)

OTHER PUBLICATIONS

Extended European Search Report issued in corresponding European Patent Application No. 14188083.1 mailed on Mar. 10, 2015 (6 pages).

(Continued)

*Primary Examiner* — Nimeshkumar Patel
*Assistant Examiner* — Christopher Raabe
(74) *Attorney, Agent, or Firm* — Osha Liang LLP

(57) ABSTRACT

There is provided a vehicle lamp including: a light source; a lens disposed on a front side of the light source and having a front surface and a rear surface which is opposite to the front surface and faces the light source, wherein the lens has a convex lens shape, and a curvature of the rear surface is larger than that of the front surface; and a reflector disposed on a rear side of the lens and configured to reflect direct light emitted from the light source toward the lens. The vehicle lamp is configured to form a light distribution pattern by controlling a deflection of the direct light using the lens.

8 Claims, 6 Drawing Sheets

(56) References Cited

FOREIGN PATENT DOCUMENTS

| | | | |
|---|---|---|---|
| JP | 2010-073426 | A | 4/2010 |
| JP | 2013-026185 | A | 2/2013 |
| WO | 2012/176653 | A1 | 12/2012 |

OTHER PUBLICATIONS

Office Action issued in corresponding Chinese Application No. 201410514189.6, mailed on May 24, 2016 (16 pages).

* cited by examiner

VEHICLE LAMP

CROSS-REFERENCE TO RELATED APPLICATION

This application claims priority from Japanese Patent Application No. 2013-213872, filed on Oct. 11, 2013, the entire contents of which are hereby incorporated by reference.

BACKGROUND

1. Technical Field

The present disclosure relates to a vehicle lamp which is configured to form a light distribution pattern by subjecting direct light emitted from a light source to deflection control using a lens disposed on the front side thereof.

2. Description of the Related Art

For example, as disclosed in JP-A-2013-26185, there is known a so-called direct projection-type vehicle lamp which is configured to form a light distribution pattern by subjecting the light emitted from a light source to deflection control using a lens disposed on the front side thereof.

In the direct projection-type vehicle lamp, there is a problem that it is not easy to increase the utilization efficiency of the light emitted from the light source and therefore it is not possible to sufficiently secure the brightness of a light distribution pattern.

On the contrary, by adopting a configuration in which a reflector for reflecting the direct light from the light source toward the lens is disposed on the rear side of the lens, it is possible to improve the utilization efficiency of the light emitted from the light source by the amount of light reflected by the reflector.

However, generally, a lens used in the direct projection-type vehicle lamp has a convex lens shape where the curvature of the front surface is larger than that of the rear surface. Accordingly, in case of adding the reflector simply, there exists a problem in that a portion of the light that is reflected by the reflector and incident on the lens is totally reflected at the front surface of the lens. As a result, there is a problem in that it is not possible to sufficiently increase the light emission efficiency from the lens and thus it is difficult to secure a sufficient brightness of the light distribution pattern.

SUMMARY OF THE INVENTION

The present invention is directed toward a vehicle lamp which is configured to form a light distribution pattern by subjecting direct light emitted from a light source to deflection control using a lens disposed on the front side of the light source and which is capable of sufficiently securing the brightness of a light distribution pattern using a reflector.

According to one or more aspects of the present invention, there is provided a vehicle lamp comprising: a light source; a lens disposed on a front side of the light source and having a front surface and a rear surface which is opposite to the front surface and faces the light source, wherein the lens has a convex lens shape, and a curvature of the rear surface is larger than that of the front surface; and a reflector disposed on a rear side of the lens and configured to reflect direct light emitted from the light source toward the lens. The vehicle lamp is configured to form a light distribution pattern by controlling a deflection of the direct light using the lens.

The type of the "light source" is not particularly limited. For example, a light emitting element such as a light emitting diode and a laser diode, or a light source bulb or the like can be employed as the light source.

A specific curvature size of each of the front surface and the rear surface in the "lens" is not particularly limited, as long as the lens has a convex lens shape where the curvature of the rear surface is larger than that of the front surface.

The type of the "light distribution pattern" is not particularly limited. For example, a low-beam light distribution pattern, a high-beam light distribution pattern, a fog-lamp light distribution pattern or the like can be employed.

A specific arrangement and light reflecting structure and the like of the "reflector" is not particularly limited, as long as the reflector is configured to reflect the direct light from the light source toward the lens.

As illustrated in the above configuration, the vehicle lamp according to the present invention is configured to form a light distribution pattern by controlling the deflection of the direct light from the light source using the lens disposed on the front side thereof. However, since the reflector for reflecting the direct light from the light source toward the lens is disposed on the rear side of the lens, it is possible to improve the utilization efficiency of the light emitted from the light source by the amount of light reflected by the reflector.

At that time, since the lens has a convex lens shape where the curvature of the rear surface is larger than that of the front surface, it is possible to cause the light reflected by the reflector to be gradually refracted on the front surface and the rear surface of the lens. Therefore, in the light that is reflected by the reflector and incident on the lens, the percentage of the light that is totally reflected on the front surface of the lens can be reduced to zero or the percentage can be significantly reduced as compared to the prior art configuration. Thus, it is possible to sufficiently improve the light emission efficiency from the lens.

Accordingly, it is possible to sufficiently secure the brightness of the light distribution pattern using the reflector.

According to the present invention as described above, in the vehicle lamp configured to form a light distribution pattern by controlling the deflection of the direct light emitted from the light source using the lens disposed on the front side thereof, it is possible to sufficiently secure the brightness of the light distribution pattern using the reflector.

Furthermore, when the curvature of the rear surface of the lens is larger than that of the front surface, as described in the present invention, it is possible to easily secure a space for placing the reflector. Thereby, it is possible to prevent, in advance, the size of the lamp unit from being increased due to the addition of the reflector.

In the above configuration, by adopting a configuration that the reflector has a multistage reflective surface, it is possible to finely control the size and forming position of a light distribution pattern which is formed by the light reflected by the reflector. Thereby, it is possible to reduce the light unevenness of the whole light distribution pattern.

In the above configuration, by adopting a configuration that a portion of the rear surface of the lens, which faces the reflector, has a linear cross-sectional shape, it can be easily prevented that the light reflected by the reflector is largely refracted on the rear surface of the lens and totally reflected on the front surface of the lens.

In the above configuration, by adopting a configuration that a panel member is disposed around the lens, it is possible to improve the design of the lamp.

At that time, the panel member may be formed with a wall surface portion extending forward from near an outer peripheral edge of the lens. In this case, at least a portion of the reflector is disposed on one side with respect to an axis while the wall surface portion is disposed on the other side with respect to the axis, wherein the axis extends in a forward and rearward direction so as to pass through the light source. With these configurations, the following operational effects can be obtained.

Namely, when a portion of the light emitted from the lens is shielded by the wall surface portion of the panel member, the brightness of the end portion of the light distribution pattern on the side where the wall surface portion is disposed is lowered. On the contrary, when the light reflected by the reflector and passing through the lens is directed toward the wall surface portion side through the axis, the reflector can provide the brightness corresponding to the amount of light shielded by the wall surface portion of the panel member. Accordingly, it is possible to prevent, in advance, the brightness of the end portion of the light distribution pattern on the side where the wall surface portion is disposed from being lowered. As a result, it is possible to form the light distribution pattern with a desired brightness.

In the above configuration, by adopting a configuration that the reflector is disposed around the light source, and the direct light reflected by the reflector is directed toward an axis, wherein the axis extends in a forward and rearward direction so as to pass through the light source, it is possible to prevent, in advance, the brightness of the end portion of the light distribution pattern on the side where the wall surface portion is disposed from being inadvertently lowered due to a structure around the lens.

DETAILED DESCRIPTION

Hereinafter, embodiments of the present invention will be described in detail with reference to the accompanying drawings. Moreover, in each drawing used in descriptions below, scales are appropriately modified to show each member at a recognizable size.

Figure 1:
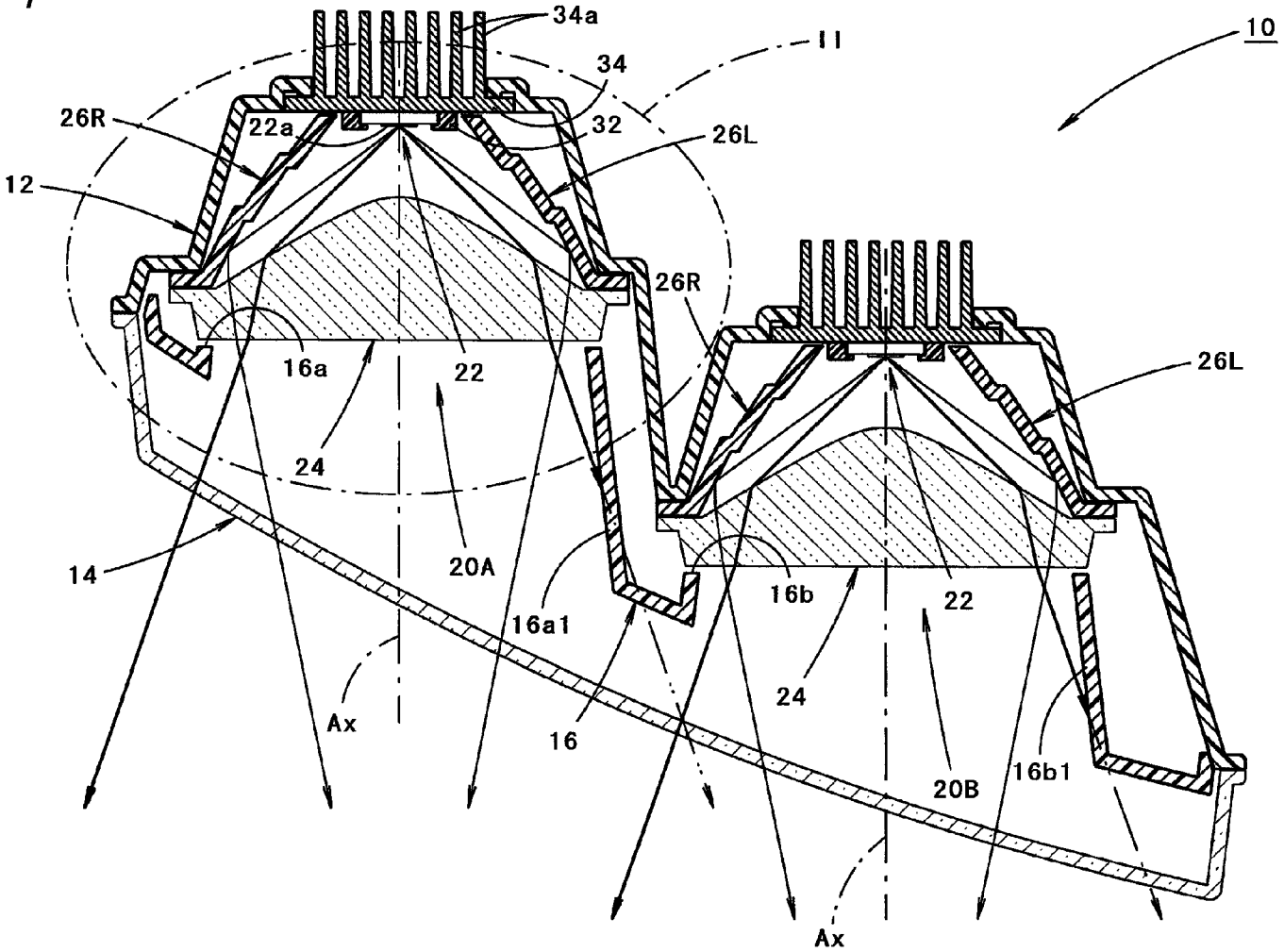
FIG. 1 is a plan sectional view showing a vehicle lamp according to an illustrative embodiment of the present invention.

FIG. 1 is a plan sectional view showing a vehicle lamp 10 according to an illustrative embodiment of the present invention.

As shown in FIG. 1, the vehicle lamp 10 is a headlamp provided on the right front end of a vehicle and has a configuration that two lamp units 20A, 20B are accommodated in a lamp chamber formed by a lamp body 12 and a translucent cover 14.

The translucent cover 14 is formed to extend to the rear from the inside in a vehicle width direction while extending in a lamp forward and rearward direction. In the lamp chamber, a panel member 16 is disposed along the translucent cover 14. At positions of the panel member 16 corresponding to respective lamp units 20A, 20B, openings 16*a*, 16*b* are respectively formed so as to surround each of the lamp units.

Two lamp units 20A, 20B are arranged in such a way that the lamp unit 20A located on the outside in the vehicle width direction is displaced to the rear side of the lamp unit 20B located on the inside in the vehicle width direction.

These two lamp units 20A, 20B have the same configurations. Accordingly, a configuration of the lamp unit 20A located on the outside in the vehicle width direction will be explained in the following description.

Figure 2:
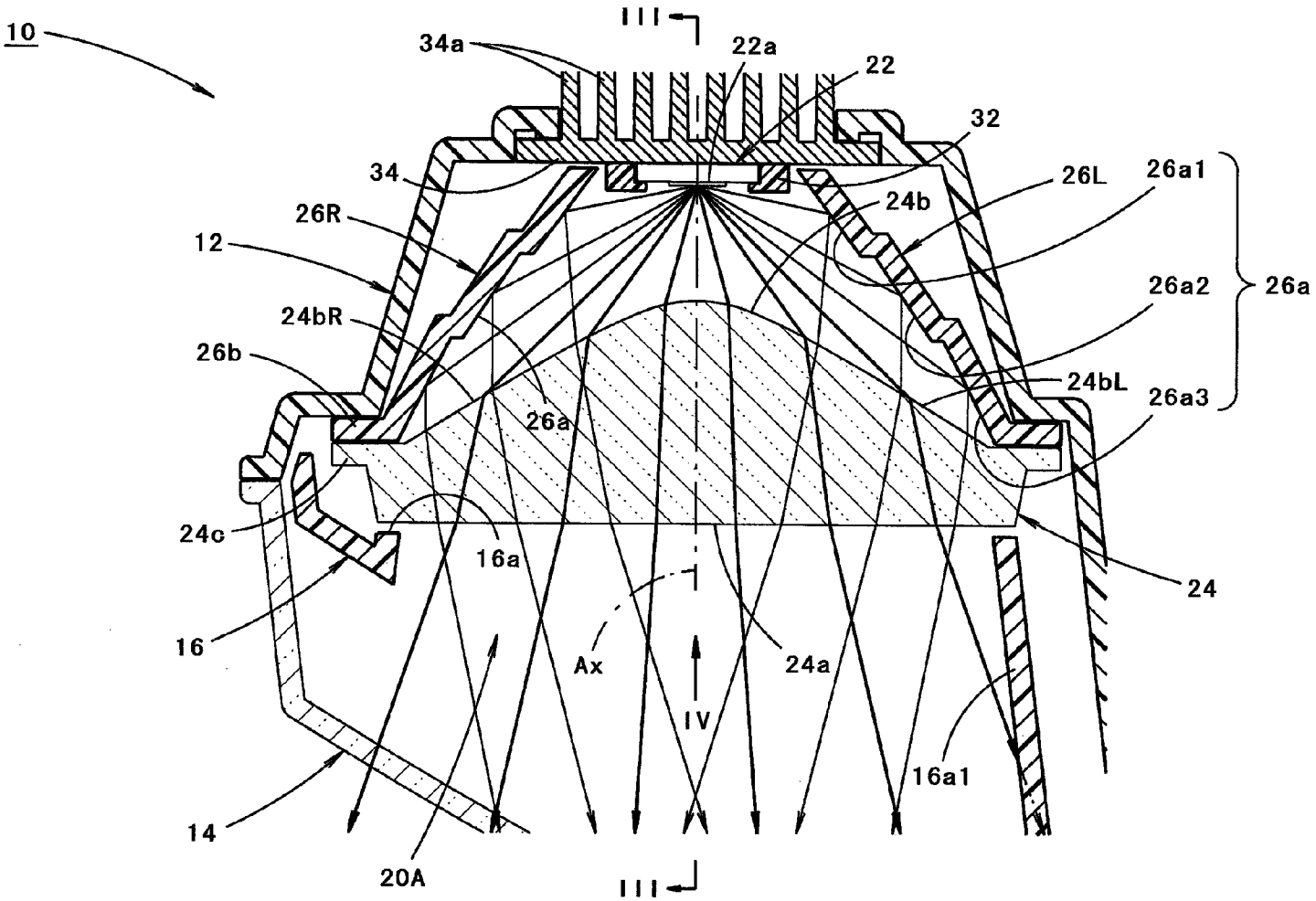
FIG. 2 is a detailed view of a region II of the vehicle lamp shown in FIG. 1.
Figure 3:
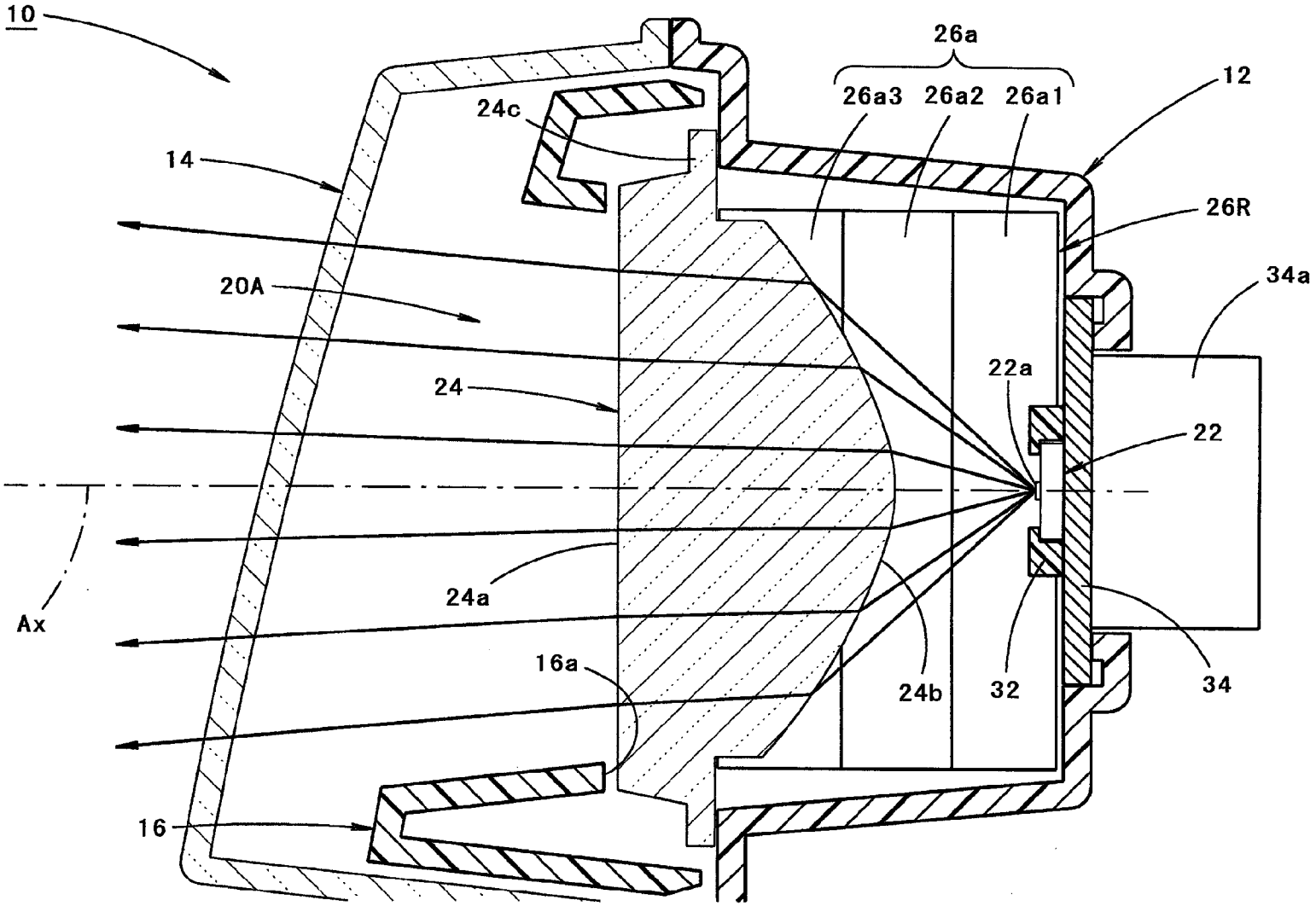
FIG. 3 is a sectional view of the vehicle lamp shown in FIG. 2, which is taken along a line III-III in FIG. 2.
Figure 4:
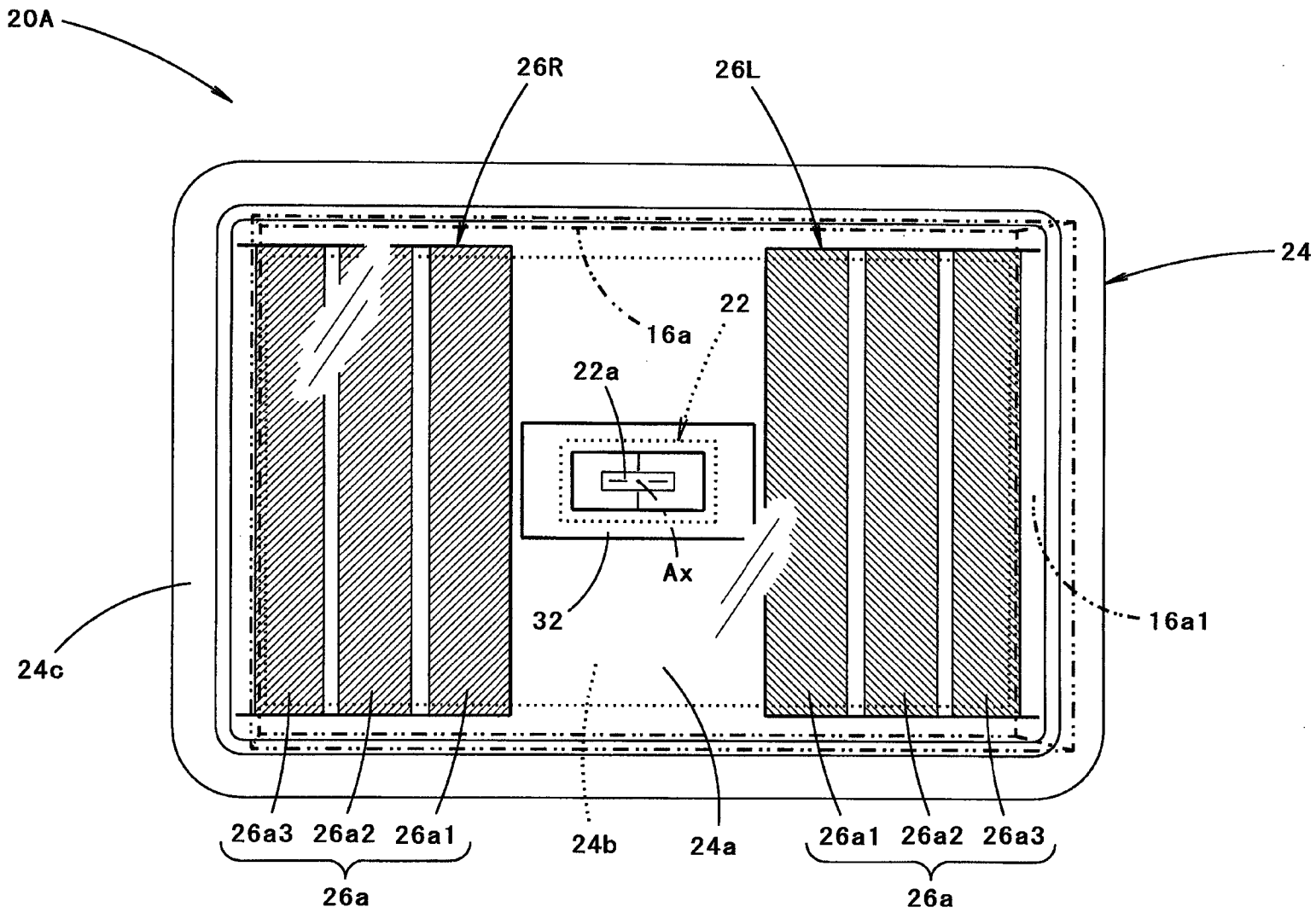
FIG. 4 is a front view of the vehicle lamp shown in FIG. 2, which is seen from a direction indicated by an arrow IV in FIG. 2.

FIG. 2 is a detailed view of a region II of the vehicle lamp 10 shown in FIG. 1. Further, FIG. 3 is a sectional view of the vehicle lamp 10 shown in FIG. 2, which is taken along a line III-III in FIG. 2. FIG. 4 is a front view of the vehicle lamp 10 shown in FIG. 2, which is seen from a direction indicated by an arrow IV in FIG. 2.

As shown in these figures, the lamp unit 20A includes a light source 22, a lens 24 disposed on the front side of the light source 22 and a pair of left and right reflectors 26L, 26R. The lamp unit 20A is configured to form a high-beam light distribution pattern by subjecting the light, which is emitted from the light source 22 and reflected by both reflectors 26L, 26R, to deflection control using the lens 24.

The light source 22 is a white light emitting diode. A light emitting chip 22*a* thereof includes a light emitting surface having a laterally long rectangular shape (e.g., a rectangle of about 1 mm in height×4 mm in width). The light source 22 is arranged in such a way that the light emitting chip 22*a* thereof faces a lamp front direction. The light emitting element 22 is fixed to a heat sink 34 and positioned by a light source support member 32.

The lens 24 has a convex lens shape where the curvature of a rear surface 24*b* is larger than that of a front surface 24*a*. At that time, the front surface 24*a* of the lens 24 is configured as a plane extending along a plane perpendicular to an axis Ax. Here, the axis Ax extends in a forward and rearward direction of the lamp so as to pass through the emission center of the light emitting chip 22*a*. The rear surface 24*b* of the lens 24 is configured as a free curved-surface which extends rearward in a convex form.

The lens 24 is configured as follows. A target emission angle is set in each position of the front surface 24*a* when the direct light emitted from the light source 22 is directed forward from the lens 24. Then, a shape of a free curved-surface constituting the rear surface 24*b* is set so that the direct light emitted from the light source 22 and reaching the lens 24 is incident on the lens 24 along an optical path corresponding to the target emission angle.

The target emission angle is set as follows. An emission angle in the lateral direction gradually increases as a position on the front surface 24*a* of the lens 24 is displaced away to both left and right sides from the axis Ax. Further, an emission angle in the vertical direction gradually increases as a position on the front surface 24*a* of the lens 24 is displaced away to both upper and lower sides from the axis Ax. At that time, variation in the lateral direction is set to be larger than variation in the vertical direction.

The lens 24 has an outer appearance of a laterally long rectangular shape, as seen from the front of the lamp. An outer peripheral edge 24*c* of the lens 24 has a flange shape.

The pair of left and right reflectors 26L, 26R are disposed on both left and right sides of the axis Ax in the rear side of the lens 24. At that time, both reflectors 26L, 26R are arranged in a positional relationship of bilateral symmetry about a vertical plane including the axis Ax and the reflective surfaces thereof have a bilaterally symmetrical shape. Further, each of these reflectors 26L, 26R is configured to reflect the direct light emitted from the light source 22 toward the lens 24.

Each of these reflectors 26L, 26R is provided with a multistage reflective surface 26*a*. The reflective surface 26*a* is formed by performing a mirror-surface processing (such as aluminum vapor deposition) on the front surface of each reflector 26L, 26R. Three reflective surfaces 26*a*1, 26*a*2, 26*a*3 extending vertically in a stripe shape are arranged in a stepwise manner.

All of these reflective surfaces 26*a*1, 26*a*2, 26*a*3 are respectively configured as an inclination plane extending in a direction which spreads forward and laterally with respect to the vertical plane including the axis Ax. At that time, an inclination angle to the vertical plane including the axis Ax is set as follows. Namely, the inclination angle of the reflective surface 26*a*1 closest to the axis Ax is largest and the inclination angles of the reflective surface 26*a*2 and the reflective surface 26*a*3 are gradually reduced in this order.

The reflector 26L located on the left side (on the right side, as seen from the front of the lamp), i.e., the reflector 26L on the inside in the vehicle width direction is configured to emit most of the light, which is emitted from the light source 22 and reflected by the reflective surface 26*a* thereof, toward the outside in the vehicle width direction through the lens 24. Further, the reflector 26R located on the right side is configured to emit most of the light, which is emitted from the light source 22 and reflected by the reflective surface 26*a* thereof, toward the inside in the vehicle width direction through the lens 24.

The rear surface 24*b* of the lens 24 faces the pair of left and right reflectors 26L, 26R at positions displaced away to both left and right sides from the axis Ax. Further, reflector facing portions 24*b*L, 24*b*R of the rear surface 24*b* facing the reflective surfaces 26*a* of respective reflectors 26L, 26R are formed in a horizontal cross-sectional shape having a straight line form.

A flange portion 26*b* is respectively formed in the front ends of respective reflectors 26L, 26R. The flange portion 26*b* is fixed to the outer peripheral edge 24*c* of the lens 24 and fixed to the lamp body 12.

The heat sink 34 is disposed along a plane perpendicular to the axis Ax. A plurality of cooling fins 34*a* is formed in the rear surface of the heat sink 34. An outer peripheral edge of the heat sink 34 is fixed to the lamp body 12.

A wall surface portion 16*a*1 is formed in a region of the opening 16*a* of the panel member 16, which is located on the inside in the vehicle width direction. The wall surface portion 16*a*1 extends in the forward direction from near the outer peripheral edge of the lens 24 of the lamp unit 20A.

Further, as shown in FIG. 1, a wall surface portion 16*b*1 is formed in a region of the opening 16*b* of the panel member 16, which is located on the inside in the vehicle width direction. The wall surface portion 16*b*1 extends in the forward direction from near the outer peripheral edge of the lens 24 of the lamp unit 20B.

In each of the lamp units 20A, 20B, the light emitted forward from a left region (i.e., a region located on the inside in the vehicle width direction from the axis Ax) of the lens 24 thereof is directed toward the inside in the vehicle width direction. However, a portion of the light reaches the wall surface portions 16*a*1, 16*a*2 of the panel member 16 and is shielded by the wall surface portions 16*a*1, 16*a*2.

On the other hand, in each of the lamp units 20A, 20B, most of the light, which is reflected by the right reflector 26R and emitted forward from the lens 24, is directed to the inside in the vehicle width direction. However, the emitted light is not shielded by the wall surface portions 16*a*1, 16*a*2 of the panel member 16 but directed to the front region.

Figure 5A:
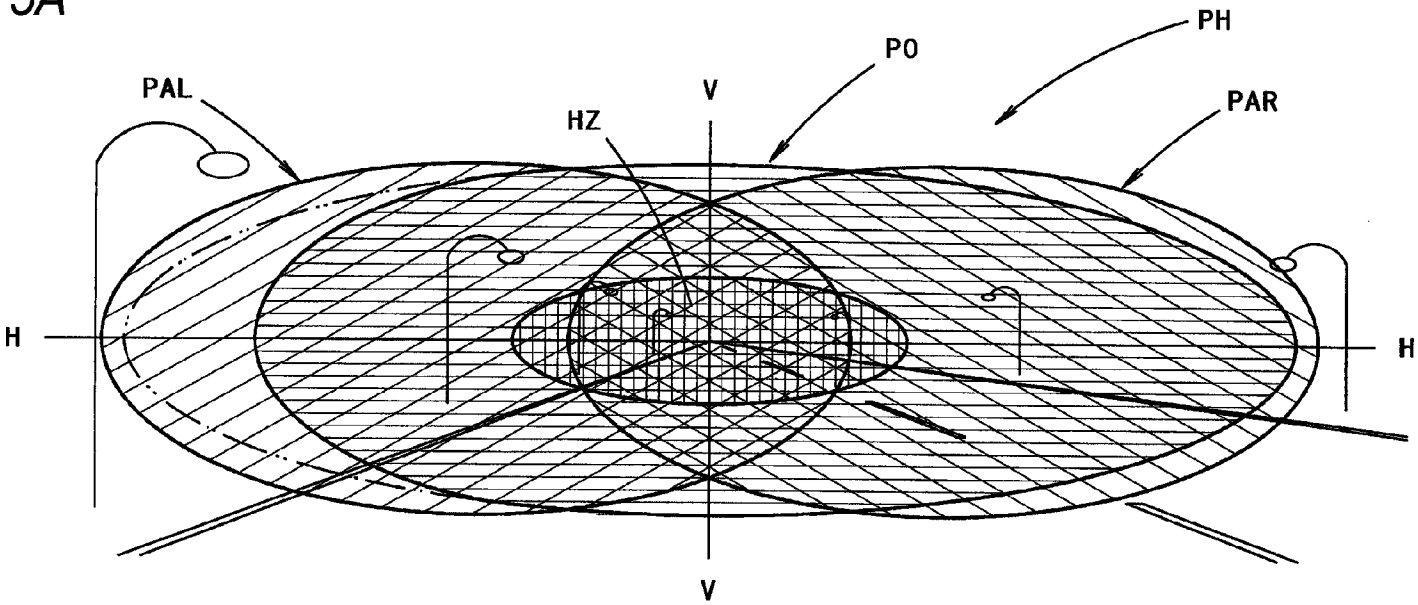
FIGS. 5A to 5C are perspective views showing a light distribution pattern that is formed on a virtual vertical screen disposed 25 m ahead of the vehicle by the light emitted forward from the vehicle lamp.

FIG. 5A is a perspective view showing a high-beam light distribution pattern PH that is formed on a virtual vertical screen disposed 25 m ahead of the vehicle by the light emitted forward from the lamp unit 20A located on the outside in the vehicle width direction.

Figure 5B:
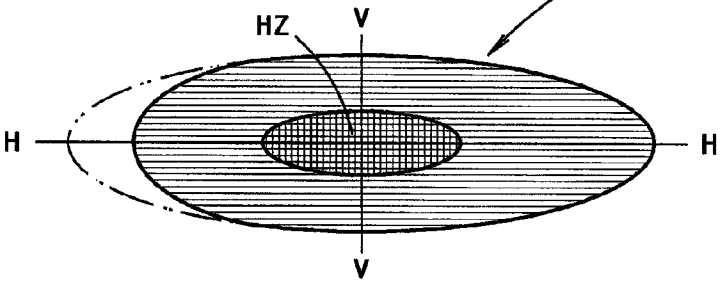
Figure 5C:
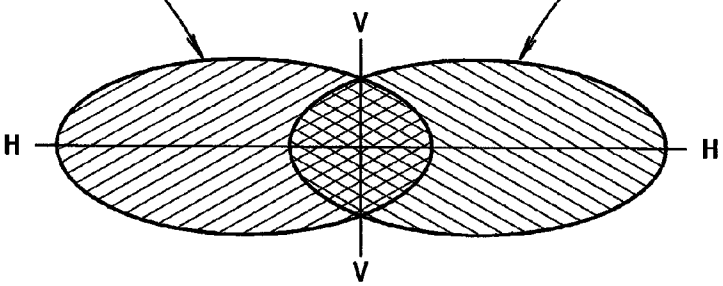

The high-beam light distribution pattern PH is formed as a combined light distribution pattern of a basic light distribution pattern PO shown in FIG. 5 B and two additional light distribution patterns PAL, PAR shown in FIG. 5C.

The basic light distribution pattern PO is a light distribution pattern that is formed by the direct light emitted from the light source 22 and reaching the lens 24.

Meanwhile, the left additional light distribution pattern PAL is a light distribution pattern that is formed by the light which is emitted from the light source 22, reflected by the right reflector 26R and reaching the lens 24. Further, the right additional light distribution pattern PAR is a light distribution pattern that is formed by the light, which is emitted from the light source 22, reflected by the left reflector 26L and reaching the lens 24.

The basic light distribution pattern PO is formed as a laterally long light distribution pattern that is largely expanded to both left and right sides with H-V point as a center and also slightly expanded in the vertical direction with the H-V as a center. The H-V point is a vanishing point in the front direction of the lamp. The basic light distribution pattern PO has a high light-intensity zone HZ with the H-V point as a center.

However, in the basic light distribution pattern PO, a maximum spread angle to the left from V-V line is slightly smaller than a maximum spread angle to the right from the V-V line. Here, the V-V line is a vertical line passing through the H-V. Namely, the maximum spread angle to the left is set to be smaller than the spread angle indicated by a two-dot chain line in FIG. 5B. The reason is that a portion of the light emitted forward from the left region of the lens 24 of the lamp unit 20A is shielded by the wall surface portion 16*a*1 of the panel member 16.

Meanwhile, both of two additional light distribution patterns PAL, PAR are formed as a slightly laterally long light distribution pattern. At that time, these two additional light distribution patterns PAL, PAR are formed in a positional relationship of bilateral symmetry with the V-V line as a center and partially overlapped with each other at the position of the V-V line.

Also in the lamp unit 20B located on the inside in the vehicle width direction, a portion of the light emitted forward from the left region of the lens 24 is shielded by the wall surface portion 16*b*1 of the panel member 16. Accordingly, a high-beam light distribution pattern is formed like the high-beam light distribution pattern PH shown in FIG. 5.

Further, the whole light distribution pattern is formed as a high beam by the overlap of two high-beam light distribution patterns formed by the light emitted from both lamp units 20A, 20B.

Next, a technical effect of the present embodiment will be described.

The lamp unit 20A of the vehicle lamp 10 according to the present embodiment is configured to form the high-beam light distribution pattern PH by controlling the deflection of the direct light emitted from the light source 22 using the lens 24 disposed on the front side thereof. However, since the pair of left and right reflectors 26L, 26R for reflecting the direct light from the light source 22 toward the lens 24 is disposed on the rear side of the lens 24, it is possible to improve the utilization efficiency of the light emitted from the light source 22 by the amount of light reflected by both reflectors 26L, 26R.

In this way, the high-beam light distribution pattern PH can be formed as a combined light distribution pattern of the basic light distribution pattern PO, which is formed by the direct light emitted from the light source 22, and the two additional light distribution patterns PAL, PAR which are formed by the light reflected by both reflectors 26L, 26R.

At that time, since the lens 24 has a convex lens shape where the curvature of the rear surface 24*b* is larger than that of the front surface 24*a*, it is possible to cause the light reflected by respective reflectors 26L, 26R to be gradually refracted on the front surface 24*a* and the rear surface 24*b* of the lens 24. Therefore, in the light that is reflected by respective reflectors 26L, 26R and incident on the lens 24, the percentage of the light that is totally reflected on the front surface 24*a* of the lens 24 can be reduced to zero or the percentage can be significantly reduced as compared to the prior art configuration. Thus, it is possible to sufficiently improve the light emission efficiency from the lens 24.

Accordingly, it is possible to sufficiently secure the brightness of the high-beam light distribution pattern PH with two reflectors 26L, 26R.

According to the present embodiment as described above, in the vehicle lamp 20A configured to form the high-beam light distribution pattern PH by controlling the deflection of the direct light emitted from the light source 22 using the lens 24 disposed on the front side thereof, it is possible to sufficiently secure the brightness of the high-beam light distribution pattern PH with two reflectors 26L, 26R.

Furthermore, in the lamp unit 20A according to the present embodiment, the curvature of the rear surface 24*b* of the lens 24 is larger than that of the front surface 24*a* and therefore it is possible to easily secure a space for placing both reflectors 26L, 26R. Thereby, it is possible to prevent, in advance, the size of the lamp unit 20A from being increased.

In the lamp unit 20A according to the present embodiment, each of the reflectors 26L, 26R has the multistage reflective surface 26*a* and therefore it is possible to finely control the size and forming position of the additional light distribution patterns PAR, PAL, which are formed by the light reflected by the reflective surface 26*a*. Thereby, it is possible to reduce the light unevenness of the high-beam light distribution pattern PH.

Further, in the lamp unit 20A according to the present embodiment, the reflector facing portions 24*b*L, 24*b*R of the rear surface 24*b* of the lens 24 facing the reflective surfaces 26*a* of respective reflectors 26L, 26R have a horizontal cross-sectional shape having a straight line form. Accordingly, it can be easily prevented that the light reflected by respective reflectors 26L, 26R is largely refracted on the rear surface 24*b* of the lens 24 and totally reflected on the front surface 24*a* of the lens 24.

Even in the case where the horizontal cross-sectional shape of respective reflector facing portions 24*b*L, 24*b*R is not a pure straight line but a curve close to a straight line, the same operational effects can be obtained.

Furthermore, in the present embodiment, the panel member 16 is disposed around the lens 24 of the lamp unit 20A and therefore it is possible to improve the design of the lamp.

At that time, the wall surface portion 16*a*1 is formed in a region of the opening 16*a* of the panel member 16, which is located on the inside in the vehicle width direction. The wall surface portion 16*a*1 extends in the forward direction from near the outer peripheral edge of the lens 24 of the lamp unit 20A. However, the reflective surface 26*a* of the right reflector 26R disposed on the outside (i.e., opposite side of the wall surface portion 16*a*1 about the axis Ax) in the vehicle width direction is formed in such a way that the light emitted from the light source 22 and reflected by the reflective surface 26*a* is directed toward the inside (i.e., the direction of the wall surface portion 16*a*1 about the axis Ax) in the vehicle width direction from the lens 24. Accordingly, the following technical effects can be obtained.

Namely, when a portion of the light emitted from the lens 24 is shielded by the wall surface portion 16*a*1 of the panel member 16, the brightness of the left end portion (i.e., end portion on the inside in the vehicle width direction where the wall surface portion 16*a*1 is disposed) of the high-beam light distribution pattern PH is lowered. On the contrary, in the present embodiment, the light reflected by the reflector 26R is emitted toward the inside in the vehicle width direction from the lens 24 and therefore the light reflected by the reflector 26R can compensate the brightness corresponding to the amount of light shielded by the wall surface portion 16*a*1 of the panel member 16. Accordingly, it is possible to prevent, in advance, the brightness of the left end portion of the high-beam light distribution pattern PA from being inadvertently lowered. As a result, it is possible to form the high-beam light distribution pattern PA with a desired brightness.

In the present embodiment, the pair of left and right reflectors 26L, 26R is disposed on the rear side of the lens 24 and on both left and right sides of the axis Ax and arranged in a shape and positional relationship of bilateral symmetry. Accordingly, when observing the lamp unit 20A from the front of the lamp, the reflective surfaces 26*a* of both reflectors 26L, 26R can be seen in the shape and positional relationship of bilateral symmetry though the lens 24. In this way, it is possible to improve the appearance of the lamp unit 20A. Furthermore, since each of the reflective surfaces 26*a* of both reflectors 26L, 26R includes three reflective surfaces 26*a*1, 26*a*2, 26*a*3 configured as a multistage reflective surface arranged in a vertical stripe, it is possible to sufficiently improve the appearance of the lamp unit 20A.

In the present embodiment, the lamp unit 20B can also obtain the same technical effects as those of the lamp unit 20A.

Although, in the present embodiment, the lens 24 of respective lamp units 20A, 20B has an outer appearance of a laterally long rectangular shape, as seen from the front of the lamp, the lens 24 may have an outer appearance (e.g., a circular shape or elliptical shape, etc.) other than the laterally long rectangular shape.

Although, in the present embodiment, each of the lamp units 20A, 20B includes a pair of left and right reflectors 26L, 26R, each of the lamp units 20A, 20B may include only one of both reflectors. Although, in the present embodiment, each of the reflectors 26L, 26R is provided with the multistage reflective surface 26*a*, each of the reflectors 26L, 26R may be provided with a single reflective surface. Furthermore, although, in the present embodiment, each of the reflectors 26L, 26R is provided at the front surface thereof with the reflective surface 26*a* that is mirror-surface processed, a configuration that fine reflective particles are included into the transparent member may be employed.

Although, in the present embodiment, the vehicle lamp 10 includes two lamp units 20A, 20B, the vehicle lamp 10 may include only the lamp unit 20A or include a lamp unit other than the lamp units 20A, 20B.

Although, in the present embodiment, the vehicle lamp 10 is a high-beam headlamp provided on the right front end of a vehicle, the vehicle lamp 10 may be configured as a high-beam headlamp provided on the left front end of a vehicle, configured as a headlamp for forming a low-beam light distribution pattern or configured as a fog lamp or a daytime running lamp.

Next, a modification of the above-described embodiment will be described.

Figure 6:
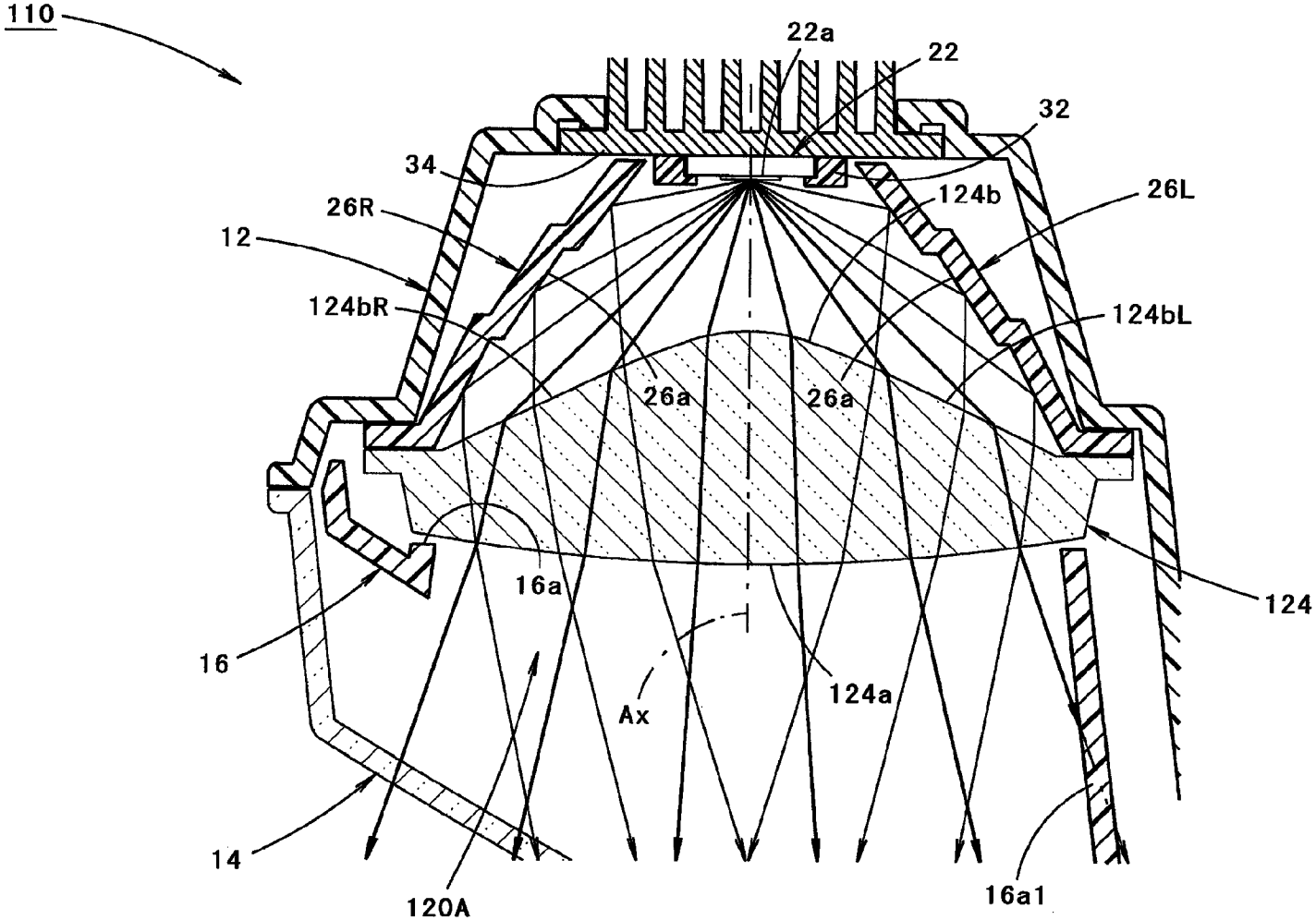
FIG. 6 is a view similar to FIG. 2, showing a vehicle lamp according to a modification of the illustrative embodiment.

FIG. 6 is a view similar to FIG. 2, showing a vehicle lamp 110 according to the modification of the embodiment.

As shown in FIG. 6, a basic configuration of the vehicle lamp 110 is the same as the above-described embodiment, but a configuration of a lens 124 in a lamp unit 120A thereof is partially different from the above-described embodiment.

Namely, in the lens 124 of the present modification, both a front surface 124*a* and a rear surface 124*b* thereof are formed in a convex curved surface. At that time, the curvature of the rear surface 124*b* is set to be larger than that of the front surface 24*a*.

The lens 124 is configured as follows. A target emission angle is set in each position of the front surface 124*a* when the direct light emitted from the light source 22 is directed forward through the lens 124. Then, a shape of a free curved-surface constituting the rear surface 124*b* is set so that the direct light emitted from the light source 22 and reaching the lens 124 is incident on the lens 124 along an optical path corresponding to the target emission angle.

At that time, of the rear surface 124*b* of the lens 124, reflector facing portions 124*b*L, 124*b*R facing the reflective surfaces 26*a* of respective reflectors 26L, 26R are formed in a horizontal cross-sectional shape having a straight line form.

With the configuration of the present modification, it is possible to obtain the same technical effects as the above-described embodiment.

Of course, the numerical values represented as specifications in the above-described embodiments and modifications thereof are merely examples and may be set to different values, as appropriate.

Further, the present invention is not limited to the configurations described in the above-described embodiments and modifications thereof but may employ other configurations that are variously changed from the configurations.

What is claimed is:

1. A vehicle lamp comprising:

a light source;

a lens disposed on a front side of the light source and having a front surface and a rear surface which is opposite to the front surface and faces the light source, wherein the lens has a convex lens shape, and a curvature of the rear surface is larger than that of the front surface; and a reflector disposed on a rear side of the lens and reflects light emitted from the light source toward the lens as reflected light, and wherein at least one reflective surface of the reflector is formed from a plurality of offset reflective surfaces, each of which reflects light from the light source towards the lens.

2. The vehicle lamp according to claim 1, wherein an entirety of the portions of the rear surface of the lens that are disposed opposite the reflector has a linear cross-sectional shape.

3. A vehicle lamp comprising:

a light source;

a lens disposed on a front side of the light source and having a front surface and a rear surface which is opposite to the front surface and faces the light source, wherein the lens has a convex lens shape, and a curvature of the rear surface is larger than that of the front surface;

a reflector disposed on a rear side of the lens and configured to reflect direct light emitted from the light source toward the lens; and a panel member disposed around the lens, wherein the vehicle lamp is configured to form a light distribution pattern by controlling a deflection of the direct light using the lens, wherein the panel member is formed with a wall surface portion extending forward from near an outer peripheral edge of the lens, at least a portion of the reflector is disposed on one side with respect to an axis while the wall surface portion is disposed on the other side with respect to the axis, wherein the axis extends in a forward and rearward direction so as to pass through the light source, and said at least the portion of the reflector is configured to reflect the light toward the wall surface portion.

4. A vehicle lamp comprising:

a light source;

a lens disposed on a front side of the light source and having a front surface and a rear surface which is opposite to the front surface and faces the light source, wherein the lens has a convex lens shape, and a curvature of the rear surface is larger than that of the front surface; and a reflector disposed on a rear side of the lens and configured to reflect light emitted from the light source toward the lens as reflected light, wherein the vehicle lamp is configured to form a light distribution pattern by controlling a deflection of the light emitted by the light source using the lens, wherein the reflector is disposed around the light source, wherein all of the reflected light reflected by the reflector is directed toward an axis, and wherein the axis extends in a forward and rearward direction so as to pass through the light source.

5. The vehicle lamp according to claim 1, wherein the lens is disposed on the optical axis of the vehicle lamp, and wherein portions of the lens on both sides of the optical axis deflect direct light from the light source away from the optical axis of the vehicle lamp.

6. The vehicle lamp according to claim 3, wherein the lens is disposed on the axis, and wherein portions of the lens on both sides of the axis deflect direct light from the light source away from the axis.

7. The vehicle lamp according to claim 4, wherein the lens is disposed on the axis, and wherein portions of the lens on both sides of the axis deflect direct light from the light source away from the axis.

8. The vehicle lamp according to claim 1, wherein the lens deflects the reflected light from the reflector on both sides of the light source towards an optical axis of the vehicle lamp.

* * * * *